US006378973B1

(12) United States Patent
Kubota et al.

(10) Patent No.: US 6,378,973 B1
(45) Date of Patent: Apr. 30, 2002

(54) METHOD AND APPARATUS FOR DRIVING AN INK JET HEAD

(75) Inventors: Atsushi Kubota, Shizuoka-ken; Hidehiro Watanabe, Tokyo; Takahisa Ikeda; Megumi Shimizu, both of Mishima, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/456,814

(22) Filed: Dec. 8, 1999

(30) Foreign Application Priority Data

Dec. 10, 1998 (JP) ..... 10-351323

(51) Int. Cl.[7] ..... B41J 25/38
(52) U.S. Cl. ..... 347/11; 347/35
(58) Field of Search ..... 347/35, 26, 34, 347/10, 11

(56) References Cited

U.S. PATENT DOCUMENTS 5,329,293 A * 7/1994 Liker ..... 347/11
5,479,196 A 12/1995 Inada

FOREIGN PATENT DOCUMENTS

| | | |
|---|---|---|
| JP | 3-246055 | 11/1991 |
| JP | 6-31932 | 2/1994 |
| JP | 9-76534 | 3/1997 |

* cited by examiner

*Primary Examiner*—John Barlow
*Assistant Examiner*—Michael S Brooke
(74) *Attorney, Agent, or Firm*—Frishauf, Holtz, Goodman, Langer & Chick, P.C.

(57) ABSTRACT

An ink jet head is provided having ink chambers, energy-generating elements provided in the ink chambers, respectively, and ink outlet ports communicating with the ink chambers, respectively. The ink jet head may be left unused for a time longer than a predetermined time, with a meniscus formed in each ink outlet port. In this case, a drive pulse is applied to each energy-generating element several times, thereby forcing the ink outwards from the ink outlet ports and increasing a surface area of the ink from a surface area of the meniscus. Then, a negative pressure is applied in each ink chamber, thereby drawing the ink back toward the ink chambers, thus forming a meniscus again in the ink outlet ports. In this condition, a drive pulse is applied to the energy-generating elements, thus ejecting an ink droplet from the ink outlet ports to record data.

4 Claims, 3 Drawing Sheets

FIG. 8A
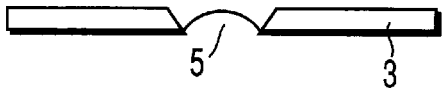
FIG. 8B
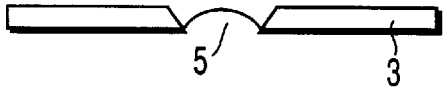
FIG. 8C
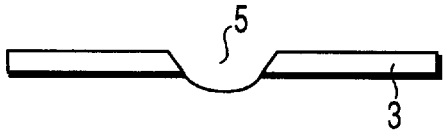
FIG. 8D
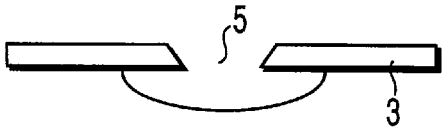
FIG. 8E
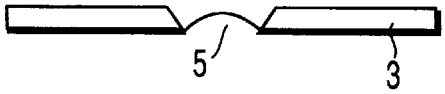
FIG. 8F
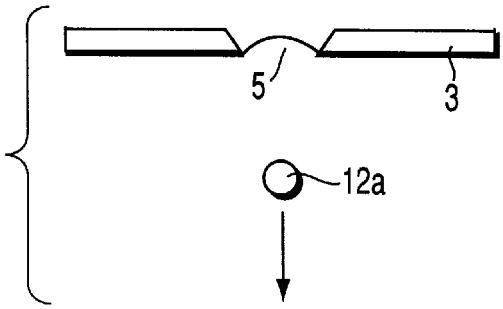
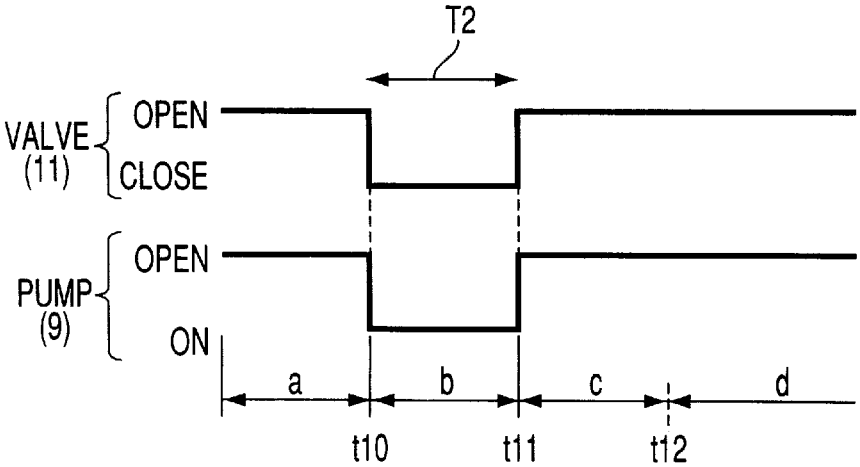
FIG. 9

METHOD AND APPARATUS FOR DRIVING AN INK JET HEAD

BACKGROUND OF THE INVENTION

The present invention relates to a method of driving an ink jet head and an apparatus for driving an ink jet head.

An ink jet head has ink outlet ports. The head ejects ink supplied from an ink reservoir through the ink outlet ports to print data on a recording medium. If the ink jet head is left unused for a long time, water or volatile constituent evaporates from the ink in the outlet ports, increasing the viscosity of the ink or forming a solid film at the air-ink interface in the outlet ports. This makes it difficult to eject the ink through the outlet ports. Thus, once the ink jet heat has been left unused for a long time, it may fail to eject ink to print data. Even if the head ejects the ink, it cannot apply the ink in the desired direction and cannot achieve high-quality printing of data.

Jpn. Pat. Appln. KOKAI Publication No. 6-31932 discloses an ink jet head which has groups of nozzles and in which ink is ejected through the nozzles of each group, some time after ink has been ejected through those of the immediately preceding group. If the ink jet head is left unused for a long time, ink is ejected first through the odd-numbered nozzles and then through the even-numbered nozzles upon lapse of a predetermined time. This preliminary ink ejection washes away the ink clogging the nozzles, so that fresh ink may be smoothly ejected through the nozzles to print data.

Such preliminary ink ejection as is disclosed in Publication No. 6-31932 wastes ink in large quantities, particularly in an ink jet head of line type, which has a great number of nozzles.

BRIEF SUMMARY OF THE INVENTION

An object of the present invention is to provide a method of driving an ink jet head to perform preliminary ink ejection without wasting ink too much, thus reliably keeping the ink outlet ports free from clogging, thereby to smoothly eject ink through the ink outlet ports.

Another object of the invention is to provide an apparatus for driving an ink jet head to perform preliminary ink ejection without wasting ink too much, thus reliably keeping the ink outlet ports free from clogging, thereby to smoothly eject ink through the ink outlet ports.

According to the first aspect of the invention, there is provided a method of driving an ink jet head which has ink chambers, energy-generating elements provided in the ink chambers, respectively, and ink outlet ports communicating with the ink chambers, respectively, and which ejects ink through the ink outlet ports by applying a drive pulse to the energy-generating elements, thereby to record data. The method comprises the steps of: forcing ink outwards from each of the ink outlet ports upon lapse of a predetermined time from formation of a meniscus in the ink outlet port, thereby increasing a surface area of the ink from a surface area of the meniscus; applying a negative pressure in each of the ink chambers, thereby drawing the ink back into the ink chamber and forming a meniscus again in the ink outlet port; and applying the drive pulse to each of the energy-generating elements, while the meniscus remains in each of the ink chambers, thereby ejecting ink from each of the ink outlet ports and recording data.

According to the second aspect of the invention, there is provided an apparatus for driving an ink jet head which has ink chambers, energy-generating elements provided in the ink chambers, respectively, and ink outlet ports communicating with the ink chambers, respectively, and which ejects ink through the ink outlet ports by applying a drive pulse to the energy-generating elements, thereby to record data. The apparatus comprises: timer means for starting measuring time when a meniscus is formed in each of the ink outlet ports; and preliminary drive means for performing preliminary drive by applying the drive pulse to each of the energy-generating elements a predetermined number of times when the time measured by the timer means reaches a preset value, thereby forcing ink outwards from each of the ink outlet ports and increasing a surface area of the ink from a surface area of the meniscus, and then by applying a negative pressure in each of the ink chambers. The drive pulse is applied to each energy-generating element after the preliminary drive means has performed the preliminary drive, thereby ejecting ink from each of the ink outlet ports and recording data.

The method according to the invention drives an ink jet head to perform preliminary drive control, without wasting ink too much, thus reliably preventing clogging in each ink outlet port to achieve stable recording of data.

The apparatus according to the invention drives an ink jet head to perform preliminary drive control, without wasting ink too much, thus reliably preventing clogging in each ink outlet port to accomplish stable recording of data.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 8A to 8F are diagrams illustrating how the air-ink interface moves at an ink outlet port of the ink jet head shown in FIG. 1; and FIG. 9 is a timing chart representing the timing of operating the valve and pump to perform preliminary ink ejection, in the head-driving apparatus that is the second embodiment of the invention.

DETAILED DESCRIPTION OF THE INVENTION

Embodiments of the present invention will be described with reference to the accompanying drawings.

First Embodiment

Figure 1:
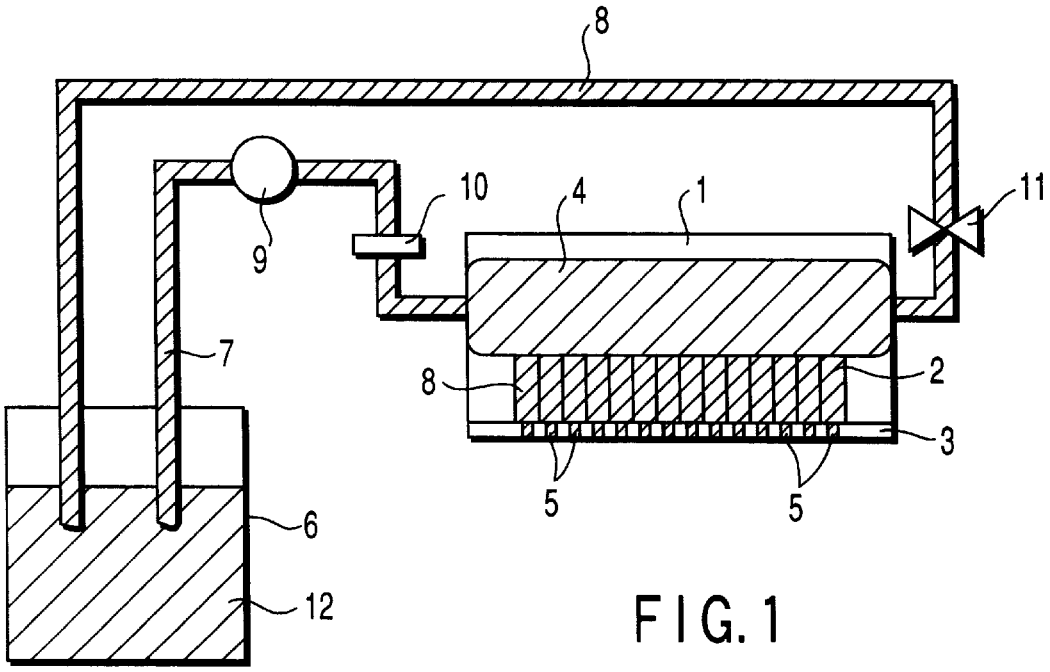
FIG. 1 is a schematic representation of an ink jet head which is driven by a head-driving apparatus that is the first embodiment of the present invention.

FIG. 1 is a schematic representation of an ink jet head. As shown in FIG. 1, the ink jet head has a head body 1. The head body 1 comprises a plurality of ink chambers 2, an orifice plate 3, and an ink reservoir 4. The ink chambers 2 are arranged side by side. The orifice plate 3 is provided in front of the ink chambers 2, and the ink reservoir 4 at the rear of the ink chambers 2. The orifice plate 3 has ink output ports 5 which communicate with the ink chambers 2, respectively. Each ink outlet port 5 has its diameter gradually decreasing toward outside.

The ink jet head further comprises an ink tank 6, an ink-supplying path 7, an ink recovery path 8, a pump 9, a filter 10, and a valve 11. The ink-supplying path 7 connects the ink tank 6 to one end of the ink reservoir 4 by an ink-supplying path 7. The ink recovery path 8 connects the ink tank 6 to the other end of the ink reservoir 4 by an ink recovery path 8. The pump 9 and filter 10 are provided on the ink-supplying path 7. The valve 11 is provided on the ink recovery path 8.

Figure 2:
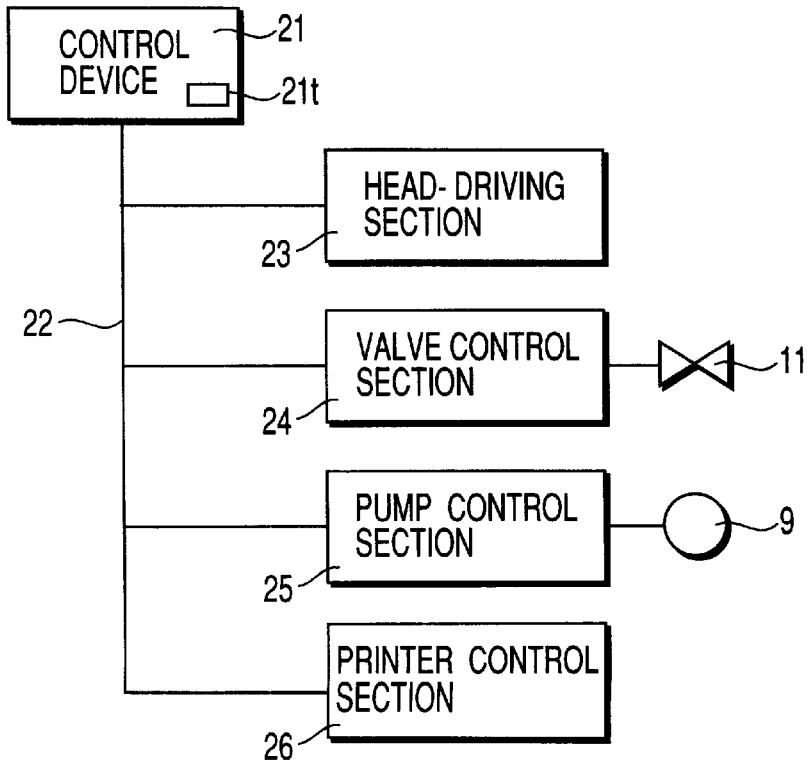
FIG. 2 is a block diagram showing the head-driving apparatus.

FIG. 2 is a block diagram showing a head-driving apparatus designed to drive the ink jet head shown in FIG. 1. The head-driving apparatus comprises a control device 21, a bus line 22, a head-driving section 23, a valve control section 24, a pump control section 25, and a printer control section 26. The control device 21 comprises a microprocessor, a memory and a timer 21*t*. The bus line 22 connects the head-driving section 23, valve control section 24, pump control section 25 and printer control section 26 to the control device 21. The valve control section 24 can open and close the valve 11 under the control of the control device 21. The pump control section 25 drives the pump 9 under the control of the control device 21.

Figure 3:
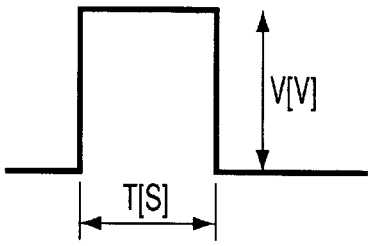
FIG. 3 shows the waveform of the drive pulse signal used in the head-driving apparatus.

The head-driving section 23 is controlled by the control device 21, to supply drive pulses to the energy-generating elements incorporated in the ink chambers 2 of the head body 1, thereby to drive the energy-generating elements. As shown in FIG. 3, the drive pulses have a width T[s], which corresponds to the pressure-transmitting time that is specific to the structure of the head body 1. The voltage of the drive pulses depends on the structure of the ink jet head.

The printer control section 26 is controlled by the control device 21, to control components other than those for driving the ink jet head, such as components designed to feed, transport and eject recording paper sheets.

The head body 1 may be a so-called kayser type head in which piezoelectric vibrating plates, each provided in a predetermined position in one ink chamber, are driven, changing the pressure in the ink chambers, thereby to eject ink outwards through the ink outlet ports. In this case, each vibrating plate is an energy-generating element. Such a drive pulse as shown in FIG. 3 is applied between the electrodes provided at the ends of each vibrating plate, whereby the plate is deformed and changing the volume of the ink chamber. As a result, the pressure in the ink chamber changes, ejecting the ink out through the ink outlet port communicating with the ink chamber. This ejection of ink is controlled by varying the drive voltage V and width T of the drive pulse shown in FIG. 3.

Alternatively, the head body 1 may be a so-called shared wall type head in which piezoelectric partitions are provided, side by side, in a space, dividing that space into ink chambers. In this case, the two adjacent partitions that define an ink chamber are deformed to change the pressure in the ink chamber, thereby to eject ink through the ink outlet port communicating the ink chamber. The piezoelectric partitions function as energy-generating elements in the shared wall type head.

Figure 4:
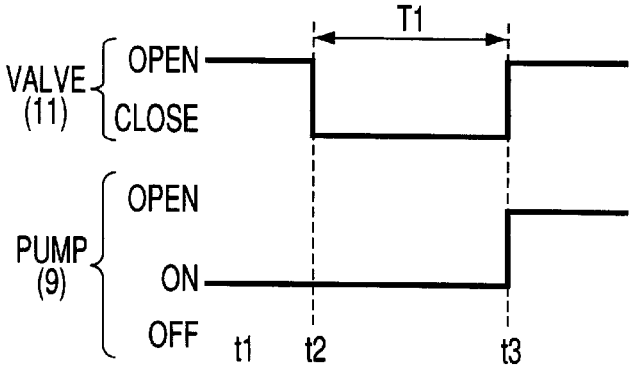
FIG. 4 is a timing chart representing the timing of operating the valve and pump in the head-driving apparatus, thereby to fill the head body with ink.

To supply ink 16 from the ink tank 6 into the head body 1, thereby to fill the body 1 with ink 16, the valve control section 24 opens the valve 11 and the pump control section 25 starts driving the pump 9, at time t1 as is illustrated in FIG. 4. The ink 12 therefore flows from the ink tank 6 into the ink reservoir 4 via the ink-supplying, after passing through the filter 10. Part of the ink 12 is forced from the ink reservoir 4 into the ink recovery path 8 and is ultimately recovered in the ink tank 6.

The valve control section 24 closes the valve 11 at time t2. Since the ink 12 is stilled flowing into the ink reservoir 4, it is supplied into the ink chambers 2 and then into the ink outlet ports 5. At time t3, or upon lapse of a predetermined time T1 from the closing of the valve 11 (time t2), the valve control section 24 opens the valve 11 and the pump control section 25 sets the pump 9 into released state.

As a result, a negative pressure is applied on the ink 12 in each ink outlet port 5 due to the difference in pressure head between the ink 12 in the ink outlet port 5 and the ink in the ink tank 6. Meniscus 13 is thereby formed in the ink outlet port 5 as is illustrated in FIG. 5.

The ink 12 is, for example, oil-based ink containing 10% or less of pigment with respect to the solvent. The ink 12 exhibits viscosity of about 10 cps at 25° C., has surface tension of about 28 dyne/cm and evaporates a very little at normal temperature.

After the meniscus 13 has been formed in each ink outlet port 5, the energy-generating element in each ink chamber 2 is driven. The pressure in the ink chamber 2 changes, whereby the ink 12 is ejected from the ink outlet port 5 to record data on a recording medium.

Figure 5:
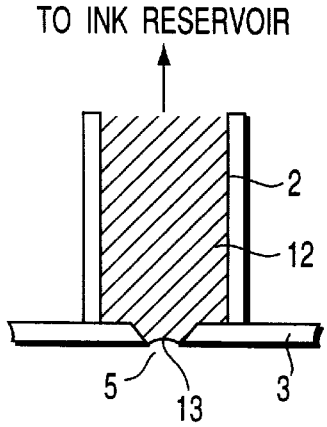
FIG. 5 is a diagram showing the ink meniscus formed in an ink outlet port of the ink jet head shown in FIG. 1.

The ink jet head may be left unused, with a meniscus formed in at the air-ink interface in the outlet port 5 as shown in FIG. 5. When the ink jet head stops recording data on the recording medium, with the ink chamber 2 filled with the ink 12, the timer 21*t* incorporated in the control device 21 starts measuring time. When the time the timer 21*t* becomes equal to or longer than a predetermined time Tmax, the viscosity of the ink 12 increases in excess or a solid film of ink is formed at the air-ink interface in the outlet port 5. Inevitably, the ink 12 will hardly be ejected.

To start recording data by the head body 1 again, the control device 21 performs preliminary drive control. More precisely, the control device 21 supplies the drive pulse (FIG. 3) repeatedly to the energy-generating element provided in each ink chamber 2.

Figure 6A:
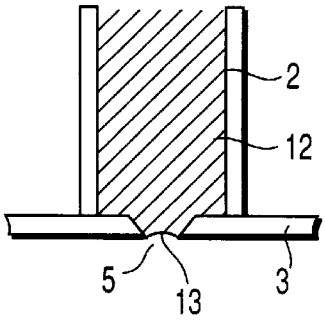
FIGS. 6A to 6C are diagrams for explaining how the first embodiment drives the ink jet head to perform preliminary ink ejection.
Figure 6B:
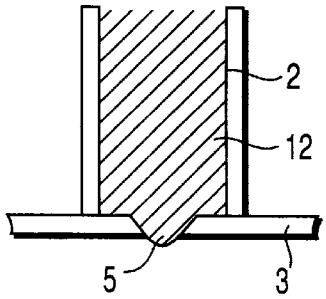
Figure 6C:
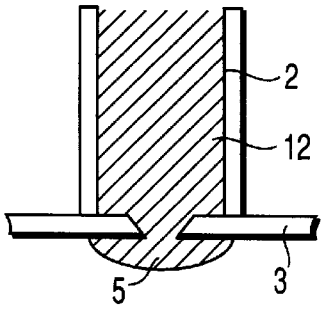

In the initial state, no changes apparently take place at the air-ink interface in each outlet port 5 as shown in FIG. 6A. When the mth drive pulse, where m is, for example, about 80, is applied to the energy-generating element, the air-ink interface bulges outwards from the port 5 as is illustrated in FIG. 6B. When the nth drive pulse, where n is, for example, about 100, is applied to the energy-generating element, the area of the air-ink interface increases as is illustrated in FIG. 6C. The area is as about ten times as large as the area the interface had when the meniscus 13 was formed in the ink outlet port 5. In the state shown in FIG. 6C, the ink 12 would not be ejected outwards. The value of n is determined on the basis of the structure of the ink jet head.

Figure 7A:
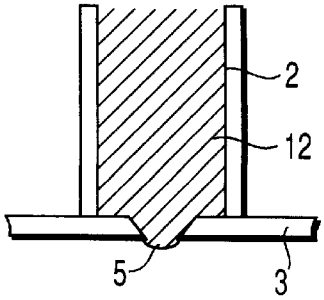
FIGS. 7A and 7B are other diagrams for explaining how the first embodiment drives the ink jet head to perform preliminary ink ejection.
Figure 7B:
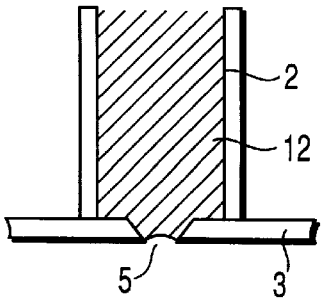

When the application of the drive pulse to the energy-generating element is stopped, a negative pressure is applied again in the ink chamber 2. The ink 12 is drawn back into the ink outlet port 5 as is illustrated in FIG. 7A. Once the meniscus 5 is formed again in the ink outlet port 5 as shown in FIG. 7B, the ink 12 is no longer drawn toward the interior of the ink chamber 2.

The preliminary drive control thus performed by the control device 21 prevents an increase in the viscosity of the ink 12 present in the ink outlet port 5 and breaks a solid ink film, if any, formed at the air-ink interface. When the drive pulse is applied to the energy-generating element to record data, an ink droplet is ejected from the ink outlet port 5 onto a recording medium. The data is thereby recorded on the recording medium.

How the air-ink interface changes at the ink outlet port 5 during the preliminary drive control is illustrated in FIGS. 8A to 8F. FIG. 8A shows the air-ink interface, or the meniscus, which exists in the ink outlet port 5 if the ink jet head has long been left unused. FIG. 8B depicts the air-ink interface in the initial phase of the repeated application of the drive pulse to the energy-generating element. FIG. 8C illustrates the air-ink interface at the time of applying the eightieth drive pulse to the energy-generating element. FIG. 8D shows the air-ink interface at the time of applying the hundredth drive pulse to the energy-generating element. As seen from FIG. 8D, the area of the interface has increased, for example, about ten times as large as the area it had in the state shown in FIG. 8A. FIG. 8E shows the shape and position the air-ink interface takes when the application of the drive pulse to the element is stopped, generating a negative pressure in the ink chamber 2, and the ink is therefore drawn into the ink chamber 2. A meniscus is thereby formed again in the ink outlet port 5. FIG. 8F represents the shape and position the air-ink interface takes when a drive pulse is applied to the energy-generating element to record data. In the state shown in FIG. 8F, an ink droplet 12*a* is ejected in the direction of the arrow.

The preliminary drive control is carried out to record data after the ink jet head has been left unused for a long time. In the preliminary drive control, the drive pulse is repeatedly applied to the energy-generating element provided in each ink chamber. As the drive pulse is thus applied to the element, the ink is not ejected from the ink outlet port at all. Instead, the air-ink interface bulges outwards from the ink outlet port 5, thereby preventing an increase in the viscosity of the ink present in the ink outlet port 5 and breaking a solid ink film, if any, formed at the air-ink interface.

Thus, the ink would not be wasted during the preliminary drive control. Further, it is possible to prevent an increase in the viscosity of the ink and break a solid ink film, if any, at the air-ink interface, thereby keeping the ink outlet ports 5 from clogging. An ink droplet can therefore be reliably ejected from each ink outlet port 5 by applying the drive pulse to the energy-generating element to record data. In short, the preliminary drive control ensures stable recording of data.

Second Embodiment

The second embodiment is identical to the first embodiment in the structure of the ink jet head and the structure of the head-driving apparatus. It differs from the first embodiment in the method of performing the preliminary drive control. More precisely, the process of forming a meniscus again, which is equivalent to the preliminary drive control, is accomplished by driving the pump 9 and the valve 11 in a specific manner, not by repeatedly applying the drive pulse to the energy-generating elements as in the first embodiment.

If the ink jet head is left unused for a long time, with an ink meniscus formed in each ink outlet port, the control device 21 performs the process of forming a meniscus again before it drives the ink jet head. When the ink jet stops recording data on a recording medium, with the ink chamber 2 filled with the ink 12, the timer 21*t* incorporated in the control device 21 starts measuring time. When the time the timer 21*t* becomes equal to or longer than a predetermined time Tmax, the viscosity of the ink 12 increases in excess or a solid film of ink is formed at the air-ink interface in the outlet port 5. Inevitably, the ink 12 will hardly be ejected.

To start recording data by the head body 1 again, the control device 21 performs the process of forming a meniscus again. More specifically, the valve control section 24 opens the valve 11 and the pump control section 25 sets the pump 9 into released state for a period a, and closes the valve 11 and causes the pump control section 25 to drive the pump 9 at time t10, as is illustrated in FIG. 9. Then, the valve control section 24 closes the valve 11 and the pump control section 25 drives the pump 9, for a prescribed period T2. The prescribed period T2 depends the shape of the jet head, the performance of the pump 9 and the like. The period T2 is set as a period during which the air-ink interface in the ink outlet port 5 bulges outwards to a prescribed distance. The pressure in the ink cumber 2 is thereby increased gradually. The air-ink interface in the ink outlet port 5 gradually bulges outwards from the ink outlet port 5. Upon lapse of the period T2, or at time t11, the area of the ink surface existing outside the port 5 increases, for example, about ten times as large as the area of the meniscus shown in FIG. 8A.

Next, the valve control section 24 opens the valve 11 and the pump control section 25 stops the pump 9, setting the same into the released state, at time t11 as is illustrated in FIG. 9. The valve 11 and the pump 9 are maintained in the opened state and released state, respectively, for a period c shown in FIG. 9. During this period c, a negative pressure is applied on the ink 12 in the ink outlet port 5 due to the difference in pressure head between the ink 12 in the ink outlet port 5 and the ink in the ink tank 6. The part of the ink, which exists outside the port 5, is therefore drawn into the ink chamber 2. Upon lapse of the period c, or at time t12, the meniscus is formed again in the ink outlet port 5 as is illustrated in FIG. 8E. When the drive pulse is applied to the energy-generating element in the period d shown in FIG. 9 to record data, an ink droplet is ejected from the ink outlet port 5 onto the recording medium, thus recording data thereon.

Thus, in the second embodiment, the valve 11 and the pump 9 are driven in the manner described above, thereby performing the process of forming a meniscus again. The process of forming a meniscus again can be achieved without wasting ink and the ink can be reliably ejected to record data after the process of forming a meniscus again, as in the first embodiment described above. The second embodiment can therefore accomplish stable recording of data.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of driving an ink jet head which has ink chambers, energy-generating elements provided in the ink chambers, respectively, and ink outlet ports communicating with the ink chambers, respectively, and which ejects ink through the ink outlet ports by applying a drive pulse to the energy-generating elements, thereby to record data, said method comprising:

forcing ink outwards from each of the ink outlet ports upon lapse of a predetermined time from formation of a meniscus in the ink outlet ports, thereby forming an ink mass outside each ink outlet port that has a diameter greater than a diameter of the ink outlet ports;

applying a negative pressure in each of the ink chambers, thereby drawing the ink back into the ink chambers and forming a meniscus again in the ink outlet ports; and applying the drive pulse to each of the energy-generating elements, while the meniscus remains in each of the ink chambers, thereby ejecting ink from each of the ink outlet ports and recording data.

2. A method of driving an ink jet head which has ink chambers, energy-generating elements provided in the ink chambers, respectively, and ink outlet ports communicating with the ink chambers, respectively, and which ejects ink through the ink outlet ports by applying a drive pulse to the energy-generating elements, thereby to record data, said method comprising:

applying the drive pulse to each of the energy-generating elements a predetermined number of times upon lapse of a predetermined time from formation of a meniscus in the ink outlet ports, thereby forcing ink outwards from each of the ink outlet ports and forming an ink mass outside each ink outlet port that has a diameter greater than a diameter of the ink outlet ports;

applying a negative pressure in each of the ink chambers, thereby drawing the ink back into the ink chambers and forming a meniscus again in the ink outlet ports; and applying the drive pulse to each of the energy-generating elements, while the meniscus remains in each of the ink chambers, thereby ejecting ink from each of the ink outlet ports and recording data.

3. An apparatus for driving an ink jet head which has ink chambers, energy-generating elements provided in the ink chambers, respectively, and ink outlet ports communicating with the ink chambers, respectively, and which ejects ink through the ink outlet ports by applying a drive pulse to the energy-generating elements, thereby to record data, said apparatus comprising:

timer means for starting a measurement of time when a meniscus is formed in each of the ink outlet ports; and preliminary drive means for performing a preliminary drive by: (i) applying the drive pulse to each of the energy-generating elements a predetermined number of times when the time measured by the timer means reaches a preset value, thereby forcing ink outwards from each of the ink outlet ports and forming an ink mass outside each ink outlet port that has a diameter greater than a diameter of the ink outlet ports, and then (ii) applying a negative pressure in each of the ink chambers, wherein the drive pulse is applied to each energy-generating element after the preliminary drive means has performed the preliminary drive, thereby ejecting ink from each of the ink outlet ports and recording data.

4. An apparatus for driving an ink jet head which has ink chambers, energy-generating elements provided in the ink chambers, respectively, and ink outlet ports communicating with the ink chambers, respectively, and which ejects ink through the ink outlet ports by applying a drive pulse to the energy-generating elements, thereby to record data, said apparatus comprising:

timer means for starting a measurement of time when a meniscus is formed in each of the ink outlet ports; and preliminary drive means for performing a preliminary drive by: (i) applying a pressure in each of the ink chambers when the time measured by the timer means reaches a preset value, thereby forcing ink outwards from each of the ink outlet ports and forming an ink mass outside each ink outlet port that has a diameter greater than a diameter of the ink outlet ports, and then (ii) applying a negative pressure in each of the ink chambers, wherein the drive pulse is applied to each energy-generating element after the preliminary drive means has performed the preliminary drive, thereby ejecting ink from each of the ink outlet ports and recording data.

* * * * *